US006367959B1

(12) United States Patent
Kraus et al.

(10) Patent No.: US 6,367,959 B1
(45) Date of Patent: Apr. 9, 2002

(54) METHOD AND APPARATUS FOR BLENDING WATER WITH SAND

(75) Inventors: Richard B. Kraus, Barrington; Richard P. Kempf, Hainesville, both of IL (US)

(73) Assignee: General Kinematics Corporation, Barrington, IL (US)

( * ) Notice: Subject to any disclaimer, the term of this patent is extended or adjusted under 35 U.S.C. 154(b) by 0 days.

(21) Appl. No.: 09/507,434

(22) Filed: Feb. 19, 2000

(51) Int. Cl.[7] ..... B28C 5/08; B01F 5/00; B01F 5/26; B01F 7/04

(52) U.S. Cl. ..... 366/137.1; 366/3; 366/13; 366/137.1; 366/196; 366/300

(58) Field of Search ..... 366/7, 16, 137.1, 366/152.1, 153.3, 297, 300, 66, 298, 299, 301, 10, 14, 15, 13, 40, 196, 195, 194, 3, 6

(56) References Cited

U.S. PATENT DOCUMENTS

| | | | | | |
|---|---|---|---|---|---|
| 1,849,437 | A | * | 3/1932 | Rucker | 366/137.1 |
| 2,028,745 | A | * | 1/1936 | Hendrick et al. | 366/15 |
| 3,879,021 | A | * | 4/1975 | Riley | 366/137.1 |
| 3,941,357 | A | * | 3/1976 | Wurtz | 366/301 |
| 4,190,369 | A | * | 2/1980 | Rikker | 366/16 |
| 4,231,664 | A | * | 11/1980 | Flock et al. | 366/66 |
| 4,322,168 | A | * | 3/1982 | Hartung et al. | 366/15 |
| 4,384,787 | A | * | 5/1983 | Ito et al. | 366/153.3 |
| 4,560,281 | A | * | 12/1985 | Harris et al. | 366/299 |
| 4,775,239 | A | * | 10/1988 | Martinek et al. | 366/66 |
| 4,987,850 | A | * | 1/1991 | McCracken | 366/298 |
| 5,013,157 | A | * | 5/1991 | Mills et al. | 366/15 |
| 5,401,402 | A | * | 3/1995 | Christy et al. | 366/300 |
| 5,915,833 | A | * | 6/1999 | Kruse | 366/7 |

FOREIGN PATENT DOCUMENTS

| | | | | |
|---|---|---|---|---|
| DE | 27 01 508 | * | 7/1978 | 366/66 |
| FR | 1 012 891 | * | 7/1952 | 366/137.1 |
| GB | 791 554 | * | 3/1958 | 366/137.1 |

* cited by examiner

*Primary Examiner*—Tony G. Soohoo
(74) *Attorney, Agent, or Firm*—Marshall, Gerstein & Borun

(57) ABSTRACT

A water blending apparatus for use in conditioning foundry sand. The apparatus creates a vertical sand stream flow path which increases the surface area of the sand stream and allows water to be applied to both sides of the sand stream rather than a single side, as known with conventional water mixing apparatus. In addition, the blending apparatus includes a housing inside which a pair of mixers thoroughly mix the wetted sand. Because the mixers are not positioned in-line with the main sand processing flow, as in conventional apparatus, the mixing time is not dependent upon the speed of the conveyor, and therefore mixing time may be increased. Furthermore, the agitators positioned inside the housing have a more efficient active area since a smaller clearance space is required than with over-the-conveyor style mixing devices, which must avoid contact with the conveyor belt. As a result, the sand may be cooled more quickly due to increased initial water coverage. Furthermore, the sand is cooled to a more uniform temperature since the blending apparatus more thoroughly mixes the sand and water, creating a more uniform moisture content in the sand. Still further, a post-cooling blending device may be used to introduce additional water to the sand stream, thereby activating bentonite or other materials added to the sand, which may require a higher moisture content.

20 Claims, 3 Drawing Sheets

METHOD AND APPARATUS FOR BLENDING WATER WITH SAND

FIELD OF THE INVENTION

The present invention generally relates to sand processing apparatus, and more particularly to apparatus for blending or mixing water with sand.

BACKGROUND OF THE INVENTION

Process sand is used in a variety of applications. In foundries, for example, process sand is prepared for use as molds and cores to produce castings from molten metal. The sand is mixed with bentonite, and other ingredients are typically added to the sand so that it maintains a formed shape. Molten metal is poured into the molds and allowed to cool, thereby forming a solid casting. A shake-out process is used to remove the sand from the casting. The shake-out process is typically conducted at relatively high temperatures so that the binder added to the sand is pyrolyzed.

In order to reduce sand consumption, it is common for foundries to include sand reconditioning apparatus which allows the sand to be reused in subsequent molds. Because the sand has a relatively high temperature as it exits the shake-out, it is common for the reconditioning apparatus to add water to the sand to reduce the temperature of the sand. The temperature of the sand is most quickly and efficiently reduced when the water is thoroughly mixed throughout the sand. Accordingly, conventional apparatus typically includes a generally horizontal conveyor belt on which the sand is carried. One or more nozzles are positioned above the conveyor belt for spraying water onto a top surface of the sand. In addition, a mixing device is often located above a portion of the conveyor belt downstream of the water nozzles for blending the water with the sand.

Conventional mixing devices typically include a plurality of rotating paddles or blades which are positioned to engage the sand on top of the conveyor belt. As the blades rotate, the water applied to the top surface of the sand is dispersed throughout a majority of the sand. It will be appreciated, however, that the blades must be positioned so that the range of motion of the blades does not interfere with the conveyor belt, and therefore a lower layer portion of the sand will remain unmixed. In addition, since the mixing device is positioned above the conveyor belt, the blades are in contact with each section of the sand stream for only a limited amount of time as the sand is transported past the blades.

A conventionally known alternative to the rotating blades is the use of a pair of counter-rotating augers positioned below the conveyor belt. While the augers may have an increased longitudinal length to increase the amount of mixing time, the amount of mixing is still limited primarily by the speed of the augers and volume within the mixing vessel. A further drawback of such conventional mixing devices is that they are located in-line with the main sand processing flow. As a result, if the mixing device fails, the entire sand process is halted.

After the water has been added to the sand, the water and sand mixture is typically fed into cooling apparatus. Most types of cooling apparatus include a housing which is maintained at a controlled temperature. One of the more common methods of maintaining the temperature inside the enclosure is by providing air. The temperature of the air used in the cooling apparatus is controlled so that the air itself has a known enthalpy. In addition, the moisture content of the sand entering the cooling apparatus may be measured and the air temperature selected so that the sand exiting the cooling apparatus has a desired moisture content.

Upon exiting the cooling apparatus, the sand is generally suitable for remixing and further use as molds or cores. It is possible, however, that additional moisture must be added in order to activate bentonite or other materials in the sand.

SUMMARY OF THE INVENTION

In accordance with certain aspects of the present invention, apparatus for mixing water into a stream of sand is provided, the apparatus comprising a conveyor for transporting the sand stream, the conveyor having a loading end and a discharge end. A receptacle has an inlet positioned below the conveyor discharge end and an outlet, a vertical path being defined between the conveyor discharge end and the receptacle inlet. A first mixer has a rotatable shaft extending at least partially into the receptacle, and an agitator is attached to and rotates with the shaft inside the receptacle. Opposed first and second nozzle sets are provided which are adapted for attachment to a water source, each nozzle set comprising at least one nozzle directed at the vertical flow path for spraying water toward the vertical flow path. The nozzles coat opposing surfaces of the sand stream with water as the sand falls along the vertical flow path and the rotating agitator mixes the sand and water inside the receptacle.

In accordance with additional aspects of the present invention, a method of blending water with sand is provided, the method comprising the step of creating a vertical stream of sand having front and rear faces. Water is sprayed onto the front and rear faces of the sand stream to create a wetted sand stream. The wetted sand stream is collected in a receptacle and mixed to obtain a thorough mixture of sand and water.

In accordance with still further aspects of the present invention, apparatus for mixing water into a stream of sand is provided, the apparatus comprising a conveyor for transporting the sand stream, the conveyor having a loading end and a discharge end. A receptacle has an inlet positioned below the conveyor discharge end and an outlet, a vertical path being defined between the conveyor discharge end and the receptacle inlet. A first mixer has a rotatable shaft extending at least partially into the receptacle, and an agitator is attached to and rotates with the shaft inside the receptacle. A second mixer has a rotatable shaft extending at least partially into the receptacle, and an agitator is attached to and rotates with the shaft inside the receptacle. A motor drives the shafts of the first and second mixers in opposite directions. Opposed first and second nozzle sets are adapted for attachment to a water source, each nozzle set comprising at least one nozzle directed at the vertical flow path for spraying water toward the vertical flow path. The nozzles coat opposing surfaces of the sand stream with water as the sand falls along the vertical flow path and the rotating agitator mixes the sand and water inside the receptacle.

DETAILED DESCRIPTION OF THE PREFERRED EMBODIMENTS

Figure 1:
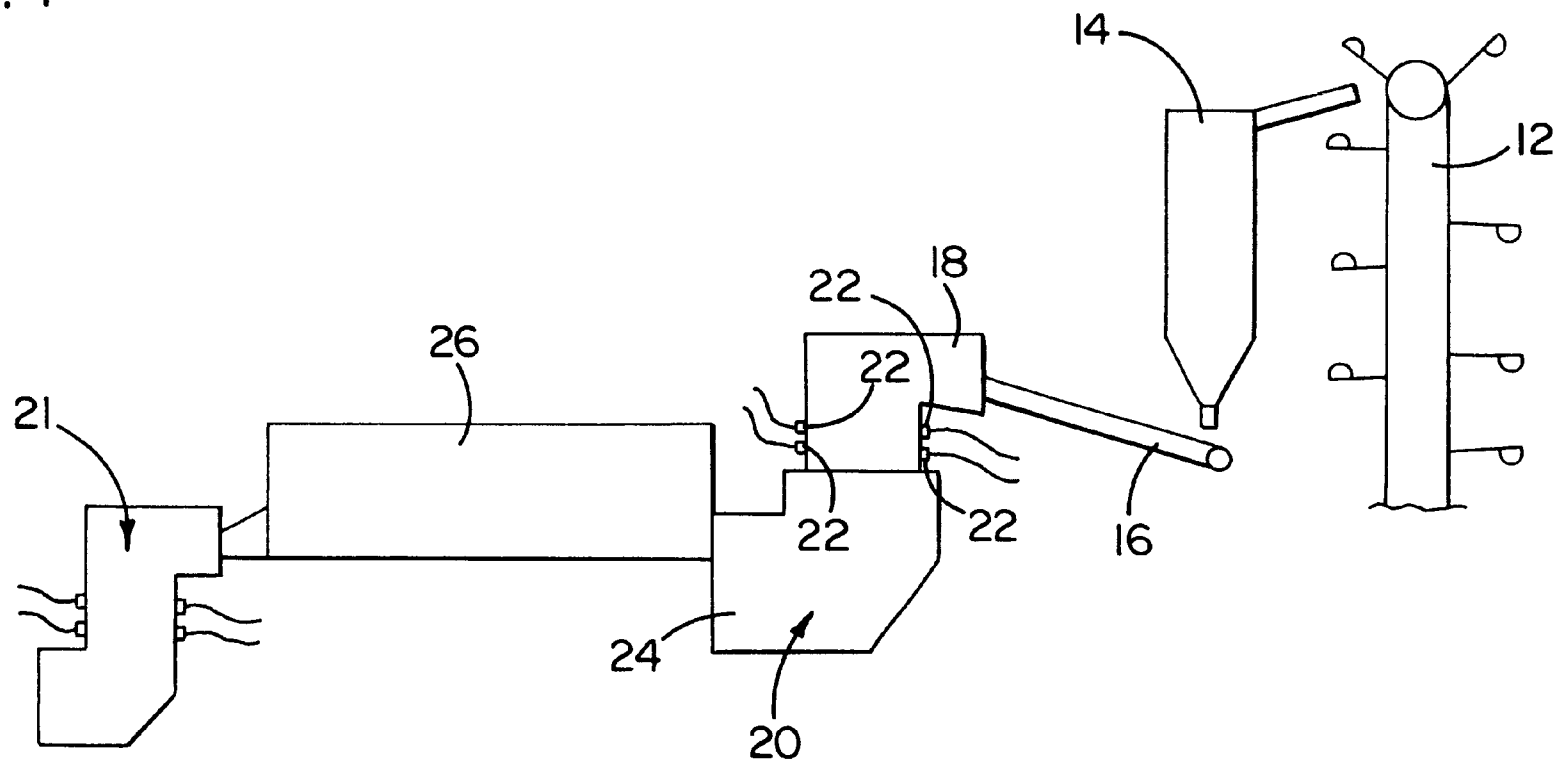
FIG. 1 is a schematic diagram illustrating sand preparation apparatus including the blending apparatus of the present invention.

A system for transporting and reconditioning sand for reuse as foundry molds and cores is schematically illustrated at FIG. 1. The system generally comprises a vertical transport such as a bucket elevator 12 which receives sand from the shake-out apparatus (not shown). As noted above, the sand has been used to form castings and was heated during the shake-out process, and therefore the sand is at a relatively high temperature, on the order of 200–400° F. The bucket elevator 12 dispenses the sand into a hopper 14, which has an outlet positioned over a loading end of a conveyor 16. The conveyor 16 may be completely horizontal or, as shown in FIG. 1, sloped to transport the sand both horizontally and vertically. The conveyor 16 also has a discharge end positioned inside a hood 18 of a water blending device 20 in accordance with the present invention. The water blending device 20 includes a plurality of nozzles 22 positioned on opposite sides of the hood 18 and a mixing section 24. An outlet of the water blending device 20 communicates with cooling apparatus 26. According to the embodiment illustrated in FIG. 1, an optional second water blending device 21 is positioned at the outlet of the cooling apparatus 26.

In operation, the bucket elevator 12 fills the hopper 14 with hot sand. The hopper 14 discharges a continuous stream of sand having a relatively constant volume through its outlet onto the loading end of the conveyor 16. The conveyor 16 advances the continuous sand stream to the discharge end, where the sand is discharged into the water blending device 20 for mixing water with the sand. The sand next enters the cooling apparatus 26 where the temperature of the sand is reduced to the desired level. The water added to the sand helps cool the sand more quickly, thereby reducing the time needed to condition the sand for reuse. The cooled sand is then deposited into the optional second water blending device 21, where additional water may be added to the sand to obtain a desired moisture content. The prepared sand is then transported to a mold forming area (not shown).

Figure 2:
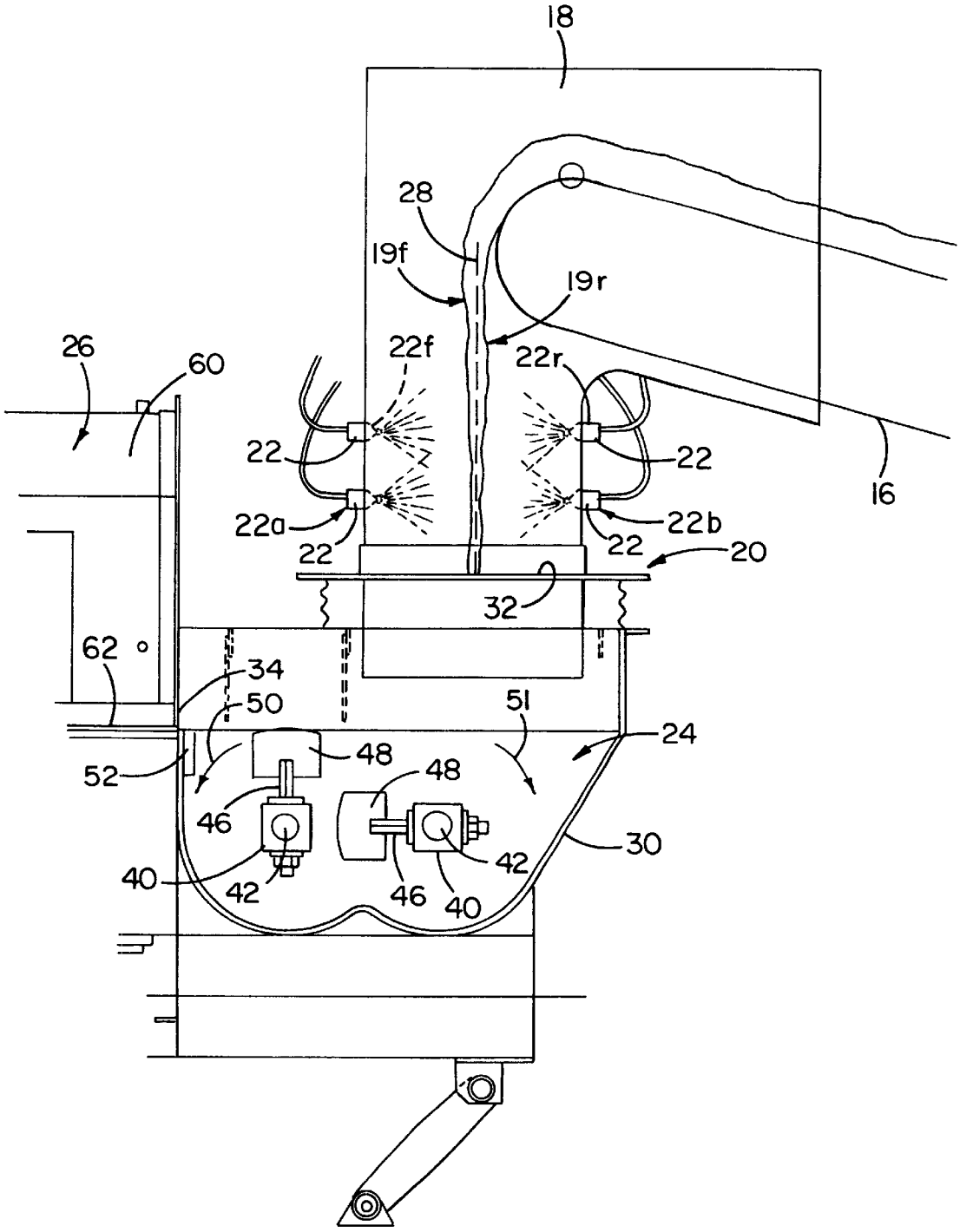
FIG. 2 is a side elevation view, with portions partially removed, of blending apparatus in accordance with the present invention.

As best shown in FIG. 2, the water blending device 20 is positioned with respect to the conveyor 16 so that the sand stream falls along a generally vertical path 28 into the mixing section 24. It will be appreciated that the sand stream is typically advanced by the conveyor 16 at the rate of approximately 50 feet/minute. When the sand stream is discharged from the conveyor 16, however, gravity quickly accelerates the sand stream to a velocity that is much greater than the conveyor speed. For example, by the time the sand stream falls approximately 1 foot below the conveyor discharge end, the sand stream has already achieved a speed of approximately 240 feet/minute. Accordingly, as the sand stream falls along the vertical path 28, the thickness of the sand stream becomes more spread out (or less dense), thereby increasing the exposed surface area of the sand stream. As illustrated in FIG. 2, the thickness of the sand stream gradually tapers due to constant acceleration generated by the force of gravity.

In addition, because the sand stream is no longer supported by the conveyor, it has accessible front and rear faces 19*f*, 19*r*. The water nozzles 22 are positioned on opposing sides of the hood 18 to direct water onto the front and rear faces 19*f*, 19*r* of the falling sand stream. According to the illustrated embodiment shown at FIGS. 2 and 3, the water nozzles 22 are provided as two sets of nozzles 22*a*, 22*b*, each set comprising two vertically spaced rows 23 having nozzles 22 spaced horizontally along each row. The horizontal spacing of the nozzles 22 ensures that water is directed across the entire lateral width of the sand stream. While the illustrated embodiment shows two sets of nozzles, it will be appreciated that more than two sets of nozzles may be used in accordance with the present invention. Furthermore, each set may comprise a single row or more than two rows of nozzles without departing from the scope of the present invention.

Each nozzle 22 of set 22*a* is preferably positioned to aim directly at a nozzle 22 of the opposing set 22*b*, so that the sand stream maintains a substantially consistent vertical direction. As illustrated in FIG. 2, the nozzle 22*f* is positioned at the same elevation as nozzle 22*r*. Furthermore, these nozzles are directed at the same point along the vertical path 28. As a result, the force of nozzle 22*f* is counterbalanced by the force of nozzle 22*r*. If the nozzle 22*f* was directed at a higher point than the nozzle 22*r*, the sand stream would be pushed toward the right by nozzle 22*f* and subsequently toward the left by nozzle 22*r*, thereby creating a dispersed and turbulent sand stream. By directing pairs of opposing nozzles at the same point along the vertical path 28, the sand stream maintains a substantially constant flow direction.

From the above, it will be appreciated that at least twice as much sand is initially covered by water than in conventional systems, in which the water nozzles are capable of directing water toward only a top layer of the sand stream. Not only is the water directed at opposing faces 19*f*, 19*r* of the sand stream, but the sand stream also has a greater surface area exposed to the water so that a greater volume of sand is in direct contact with the water.

The wetted sand continues to fall through the hood 18 until it collects in a housing 30 of the mixing section 24. As best shown in FIG. 2, the housing 30 has an inlet 32 which fluidly communicates with an outlet of the hood 18. The housing 30 further defines an outlet 34 which fluidly communicates with an inlet of the cooling apparatus 26.

Figure 3:
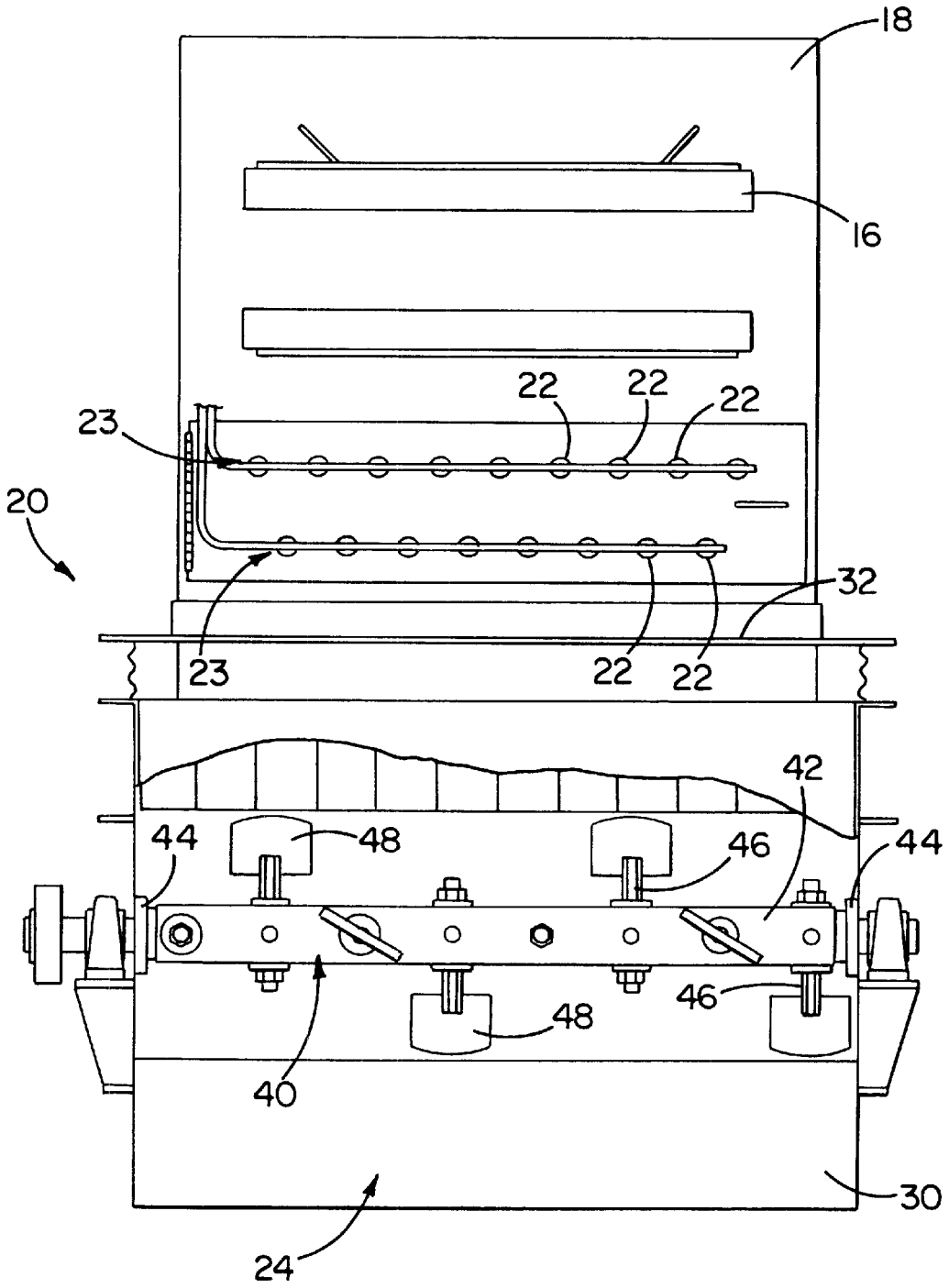
FIG. 3 is a front elevation view, with portions partially removed, of blending apparatus in accordance with the present invention.

A pair of mixers 40 are disposed inside the housing 30 to stir the sand collected in the housing 30, thereby more thoroughly blending the water with the sand. As best shown with reference to FIGS. 2 and 3, each mixer 40 includes a rotating shaft 42 extending through the housing 30 and journally supported at opposite ends. Seals 44 close off the apertures in the housing 30 through which the shaft 42 passes. One or more agitators are attached to the shaft 42 for mixing the sand and water deposited in the housing 30. As used herein, the term "agitator" is intended to include paddles, blades, ribbons, or any other type of structure used to create a mixing action. According to the illustrated embodiment, a plurality of paddles 48 comprise the agitators. The paddles 48 are attached to various points along the shaft 42 by a plurality of arms 46 so that the paddles rotate with the shaft 42 to create a mixing action. As best shown in FIG. 3, the paddles 48 are preferably angled with respect to an axis of the shaft 42 to impart a more dynamic mixing motion. According to the illustrated embodiment, the arms 46 extend through the shaft 42 and are releasibly fastened, such as with bolts 46 to the shaft. In accordance with certain aspects of the present invention, the amount of clearance between the blades 48 and the interior surface of the housing 30 is relatively small, thereby maximizing the active mixing volume of the housing 30. Because the housing 30 is stationary, it may be formed of a durable material, such as steel.

The shafts 42 are coupled to a single motor (not shown) or a pair of dedicated motors (also not shown) which preferably drive the shafts 42 in opposite directions. As shown in FIG. 2, for example, the left shaft 42 may be driven in a counter-clockwise direction indicated by arrow 50, while the right shaft 42 is driven in a clockwise direction indicated by arrow 51. The counter rotating shafts 42 further impart a more vigorous mixing motion.

In addition, the paddles of each shaft are preferably positioned with respect to the other shaft so as to maximize mixing efficiency. As best illustrated in FIG. 2, the paddles of the right shaft are positioned 90° out of phase with respect to the paddles of the left shaft. Rotation of the shafts is timed so that the phase difference is maintained during operation, thereby imparting a more thorough mixing action.

As additional wetted sand is continuously added to the housing, a portion of the water/sand mixture continuously flows out the outlet 34 of the housing 30. An adjustable weir 52 is preferably positioned at the outlet 34 of the housing 30 to control the rate at which the sand is supplied to the cooling apparatus 26. As illustrated in FIG. 2, the weir 52 is positioned at the outlet 34 and is vertically adjustable to increase or decrease the weir height. The outlet 34 is preferably positioned above the mixers 40 so that, in the event the mixers 40 fail, they do not obstruct the continued flow of sand into the cooling apparatus 26. Accordingly, the entire sand conditioning system will not shut down if the mixers 40 fail.

The cooling apparatus 26 is provided downstream of the water blending device 20 to reduce the temperature of the sand to a desired level. In the illustrated embodiment, the cooling apparatus 26 comprises a housing 60 having a vibrating conveyor bed 62. Pressurized air is introduced through the bed 62 to fluidize the sand as it advances through the housing 60. The use of a fluidized bed, while advantageously creating a more uniformed sand temperature, is not necessary, and other types of cooling apparatus may be used herein without departing from the scope of the present invention.

A second water blending device 21 may be positioned at an outlet of the cooling apparatus 26 to further condition the sand for reuse (FIG. 1). As noted above, the sand may contain bentonite or other materials which help the sand retain its molded shape. These materials may require a certain moisture level before they are activated. Accordingly, the second water blending device 21 includes the same nozzles 22 as the first device 20 for adding additional water to the already cooled sand to increase the moisture content, thereby activating the materials added to the sand. The second water blending device 21 is identical to the one described above, and includes the rotating shafts 42 and paddles noted above. As a result, the additional moisture is thoroughly mixed throughout the entire sand stream, so that the sand has a uniform moisture content.

In view of the foregoing, it will be appreciated that the present invention brings to the art new and improved water blending apparatus for use in conditioning foundry sand. The apparatus creates a vertical sand stream flow path which increases the surface area of the sand stream and allows water to be applied to both sides of the sand stream rather than a single side, as is known with conventional apparatus. In addition, the blending apparatus includes a housing inside which a pair of mixers thoroughly mix the wetted sand. Because the mixers are not positioned in-line with the main sand processing flow, as in conventional apparatus, the mixing time is not dependent upon the speed of the conveyor, and therefore mixing time may be increased. Furthermore, the agitators positioned inside the housing have a more efficient active area since a smaller clearance space is required than with over-the-conveyor style mixing devices, which must avoid contact with the conveyor belt.

Because of the foregoing, the sand may be cooled more quickly due to increased initial water coverage. Furthermore, the sand is cooled to a more uniform temperature since the blending apparatus more thoroughly mixes the sand and water, creating a more uniform moisture content in the sand. Still further, a post-cooling blending device may be used to introduce additional water to the sand stream, thereby activating bentonite or other materials added to the sand, which may require a higher moisture content.

The foregoing detailed description has been given for clearness of understanding only, and no unnecessary limitations should be understood therefrom, as modifications would be obvious to those skilled in the art.

What is claimed is:

1. Apparatus for mixing water and sand, the apparatus comprising:

a source of sand;

a conveyor having a loading end adapted to receive sand from the source and a discharge end, the discharge end dispensing the sand in a vertical flow path;

opposed first and second nozzle sets adapted for attachment to a water source, each nozzle set comprising at least one nozzle directed at the vertical flow path for spraying water toward the vertical flow path to create a wetted sand stream;

a receptacle having an inlet positioned below the conveyor discharge end and the first and second nozzle sets for receiving the wetted sand stream, the receptacle further having an outlet; and a first mixer having a rotatable shaft extending at least partially into the receptacle, and an agitator attached to and rotating with the shaft inside the receptacle thereby to mix the wetted sand stream, wherein the rotatable shaft and the agitator of the first mixer are positioned below the receptacle outlet and the first mixer advances the wetted sand stream out the receptacle outlet.

2. The apparatus of claim 1, in which the conveyor advances the sand stream at approximately 50 feet per minute, and the first and second nozzle sets are positioned at least 1 foot below the conveyor.

3. The apparatus of claim 1, in which the conveyor comprises a belt conveyor.

4. The apparatus of claim 1, further comprising a second mixer having a rotatable shaft extending at least partially into the receptacle, and an agitator attached to and rotating with the shaft inside the receptacle, wherein the rotatable shaft and agitator of the second mixer are positioned below the receptacle outlet.

5. The apparatus of claim 4, in which the shafts of the first and second mixers rotate in opposite directions.

6. The apparatus of claim 4, in which the agitators of the first and second mixers are positioned out of phase with respect to one another.

7. The apparatus of claim 4, in which each agitator of the first and second mixers comprises at least one paddle.

8. The apparatus of claim 1, in which each of the first and second nozzle sets comprises a plurality of vertically spaced rows, each row having a plurality of horizontally spaced nozzles.

9. The apparatus of claim 1, in which the nozzle of the first nozzle set and the nozzle of the second nozzle set are directed at a same point along the vertical flow path to form an opposed nozzle pair.

10. The apparatus of claim 9, in which the first and second nozzle sets comprise a plurality of opposed nozzle pairs.

11. Apparatus for mixing water and sand, the apparatus comprising:

a source of sand;

a conveyor having a loading end adapted to receive sand from the source and a discharge end, the discharge end dispensing the sand in a vertical flow path;

opposed first and second nozzle sets adapted for attachment to a water source, each nozzle set comprising at least one nozzle directed at the vertical flow path for spraying water toward the vertical flow path to create a wetted sand stream;

a receptacle having an inlet positioned below the conveyor discharge end and the first and second nozzle sets for receiving the wetted sand stream, the receptacle further having an outlet;

a first mixer having a rotatable shaft extending at least partially into the receptacle, and an agitator attached to and rotating with the shaft inside the receptacle thereby to mix the wetted sand stream, wherein the rotatable shaft and the agitator of the first mixer are positioned below the receptacle outlet;

a second mixer having a rotatable shaft extending at least partially into the receptacle, and an agitator attached to and rotating with the shaft inside the receptacle thereby to mix the wetted sand stream, wherein the rotatable shaft and the agitator of the second mixer are positioned below the receptacle outlet, and the first and second mixers advance the wetted sand stream out the receptacle outlet; and a motor for driving the shafts of the first and second mixers in opposite directions.

12. The apparatus of claim 11, in which each of the first and second nozzle sets comprises a plurality of vertically spaced rows, each row having a plurality of horizontally spaced nozzles.

13. The apparatus of claim 11, in which the nozzle of the first nozzle set and the nozzle of the second nozzle set are directed at a same point along the vertical flow path to form an opposed nozzle pair.

14. The apparatus of claim 13, in which the first and second nozzle sets comprise a plurality of opposed nozzle pairs.

15. The apparatus of claim 11, in which the conveyor advances the sand stream at approximately 50 feet per minute, and the first and second nozzle sets are positioned at least 1 foot below the conveyor.

16. A method of blending water with sand at an elevated temperature to help cool the sand, the method comprising:

transporting sand along a conveyor from a sand source to a discharge end of the conveyor;

discharging the sand from the conveyor discharge end to create a vertical flow path of sand having front and rear faces;

spraying water onto the front and rear faces of the vertical flow path to create a wetted sand stream;

collecting the wetted sand stream in a receptacle having an inlet positioned below the conveyor discharge end and the first and second nozzle sets for receiving the wetted sand stream, the receptacle further having an outlet; and mixing the wetted sand stream with a first mixer having a rotatable shaft extending at least partially into the receptacle and an agitator attached to and rotating with the shaft inside the receptacle, wherein the rotatable shaft and the agitator of the first mixer are located below the receptacle outlet and the first mixer advances the wetted sand stream out the receptacle outlet.

17. The method of claim 16, further comprising a second mixer having a rotatable shaft extending at least partially into the receptacle, and an agitator attached to and rotating with the second mixer shaft inside the receptacle thereby to mix the wetted sand stream, wherein the rotatable shaft and the agitator of the second mixer are positioned below the receptacle outlet.

18. The method of claim 17, in which the first and second mixers rotate in opposite directions.

19. The method of claim 16, in which opposed first and second nozzle sets are provided for spraying water onto the front and rear faces of the sand stream, the first and second nozzle sets adapted for attachment to a water source, each nozzle set comprising at least one nozzle directed at the vertical flow path.

20. The method of claim 19, in which each of the first and second nozzle sets comprises a plurality of vertically spaced rows, each row having a plurality of horizontally spaced nozzles.

* * * * *